US007913883B1

(12) United States Patent
Kaufman

(10) Patent No.: US 7,913,883 B1
(45) Date of Patent: Mar. 29, 2011

(54) HYGIENIC DISPOSABLE DENTIFRICE APPLICATOR AND ORAL PERIODONTAL CROSS CONTAMINATION PREVENTION SYSTEM

(76) Inventor: Scott Kaufman, Glen Cove, NY (US)

( * ) Notice: Subject to any disclaimer, the term of this patent is extended or adjusted under 35 U.S.C. 154(b) by 1041 days.

(21) Appl. No.: 11/690,027

(22) Filed: Mar. 22, 2007

(51) Int. Cl.
*B65D 47/00* (2006.01)

(52) U.S. Cl. ..... 222/477; 222/568; 604/110

(58) Field of Classification Search ..... 222/92, 222/10, 147, 477, 491, 492, 493, 502, 503, 222/566, 567, 568, 107, 490, 494; 137/460, 137/461, 843
See application file for complete search history.

(56) References Cited

U.S. PATENT DOCUMENTS

| | | | | | |
|---|---|---|---|---|---|
| 1,560,689 | A | * | 11/1925 | Holt et al. | 222/477 |
| 1,714,741 | A | | 5/1929 | Urquhart | |
| 1,716,617 | A | | 6/1929 | Brockelsby | |
| 2,545,115 | A | * | 3/1951 | Son | 604/117 |
| 2,718,983 | A | | 9/1955 | Deskey | |
| 3,408,150 | A | | 10/1968 | Figa | |
| 4,233,975 | A | * | 11/1980 | Yerman | 604/110 |
| 4,411,623 | A | | 10/1983 | Axelsson | |
| 4,781,683 | A | * | 11/1988 | Wozniak et al. | 604/110 |
| 4,857,061 | A | * | 8/1989 | Miller | 604/207 |
| 4,941,879 | A | * | 7/1990 | Butler et al. | 604/110 |
| 4,973,250 | A | | 11/1990 | Milman | |
| 4,993,948 | A | | 2/1991 | Cameron et al. | |
| 5,312,348 | A | * | 5/1994 | Sans | 604/110 |
| 5,322,440 | A | | 6/1994 | Steele | |
| 6,193,114 | B1 | | 2/2001 | Hopkins | |
| 6,796,737 | B2 | | 9/2004 | Ashe | |
| 6,929,475 | B1 | | 8/2005 | Dragan | |
| 6,957,958 | B2 | | 10/2005 | Rowe et al. | |
| 7,040,893 | B2 | | 5/2006 | Fischer | |

FOREIGN PATENT DOCUMENTS

| | | |
|---|---|---|
| EP | 1593351 | 11/2005 |
| FR | 2494580 | 5/1982 |
| WO | WO2006/041465 | 4/2006 |

* cited by examiner

*Primary Examiner* — Kenneth Bomberg
*Assistant Examiner* — Daniel R Shearer
(74) *Attorney, Agent, or Firm* — Michael I. Kroll

(57) ABSTRACT

A nozzle having a valve that uses the movement and viscosity of a dispensing substance to move to closure and having no means for retracting the valve results in a single-use nozzle comprising an attachable collar with a curvilinearly extending spout for easy application of dental compounds to one's teeth either directly or by means of applying to a brush from a general container such as a toothpaste tube.

21 Claims, 12 Drawing Sheets

HYGIENIC DISPOSABLE DENTIFRICE APPLICATOR AND ORAL PERIODONTAL CROSS CONTAMINATION PREVENTION SYSTEM

BACKGROUND OF THE INVENTION

1. Field of the Invention

The present invention relates generally to nozzles and, more specifically, to a hygienic single use nozzle providing a throughbore to serve as a conduit formed in a curvilinear shape for easy application of dental compounds to one's teeth either directly or by means of applying to a brush from a general container such as a toothpaste tube.

Additionally the present invention features a plurality of forms whereby within the device's throughbore an element acts as a single use valve rendering the nozzle inoperative after a single use.

Means for forming a single use valve may include movable valves and pivotal valves whereby viscosity acting upon the nozzle valve forces it into closure after a predetermined amount of material has passed through.

The purpose of the single-use nozzle in addition to the cross contamination concerns includes oral application of a substance to a user's teeth at a precise location. Such applications include an applicator for applying a substance to sensitive teeth at the gum line, applying paste between orthodontic appliances, applying a dental substance under and around bridgework, placing whitening toothpaste specifically on certain areas of tooth, applying toothpaste on hard to reach areas (toothpaste generally falls off brush before reaching all teeth) and for applying and leaving toothpaste on teeth for a short time period for absorption process, e.g. such as the time period specified by some brands of toothpastes made for sensitive teeth for absorption into dental tubules to seal teeth and prevent sensitivity.

2. Description of the Prior Art

There are other nozzles designed for single use application. While these single use applicator tips may be suitable for the purposes for which they were designed, they would not be as suitable for the purposes of the present invention, as hereinafter described.

SUMMARY OF THE PRESENT INVENTION

A primary object of the present invention is to provide a disposable single use nozzle for precise applications of dental substances.

Another object of the present invention is to provide a single-use nozzle that can be mounted to a dispenser whereby the dispenser contents can be applied along the gum line for sensitive teeth.

Yet another object of the present invention is to provide a single-use nozzle wherein a dispenser's contents can be applied as needed between orthodontic appliances and hard to reach areas.

Still another object of the present invention is to provide a single-use nozzle wherein a dispenser's contents can be applied as desired by the user to specific locations, such as when applying a whitening agent.

Another object of the present invention is to provide a disposable single use nozzle comprising a collar as means for attachment to a dispenser with a curvilinearly extending nozzle terminating with an egress port.

Yet another object of the present invention is to provide a single-use nozzle having a nozzle valve that closes after dispensing a predetermined amount of dental substance.

An additional object of the present invention is to provide a disposable single use nozzle wherein said curvilinearly extending nozzle that may have a diametrically decreasing bore.

Still yet another object of the present invention is to provide a disposable single use nozzle wherein said valve uses the viscosity and movement of the dispensing material to move the valve to closure.

Another object of the present invention is to provide a disposable single use nozzle having a pivotal valve that pivots to closure as the dispensed content moves past the valve.

Yet another object of the present invention is to provide a disposable single use nozzle having a bore movable valve that moves to closure as the dispensed contents moves through the valve.

Still yet another object of the present invention is to provide a disposable single use nozzle having a displaceable valve that moves to closure as the dispensed contents moves past the valve.

Another object of the present invention is to provide a disposable single use nozzle wherein the collar rotatably fastens to a dispensed.

Additional objects of the present invention will appear as the description proceeds.

The present invention overcomes the shortcomings of the prior art by providing a nozzle having a valve that uses the movement and viscosity of a dispensing substance to move to closure and having no means for retracting the valve results in a single-use nozzle comprising an attachable collar with a curvilinearly extending spout for easy application of dental compounds to one's teeth either directly or by means of applying to a brush from a general container such as a toothpaste tube.

The foregoing and other objects and advantages will appear from the description to follow. In the description reference is made to the accompanying drawing, which forms a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawing, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWING FIGURES

In order that the invention may be more fully understood, it will now be described, by way of example, with reference to the accompanying drawing in which.

Figure 5:
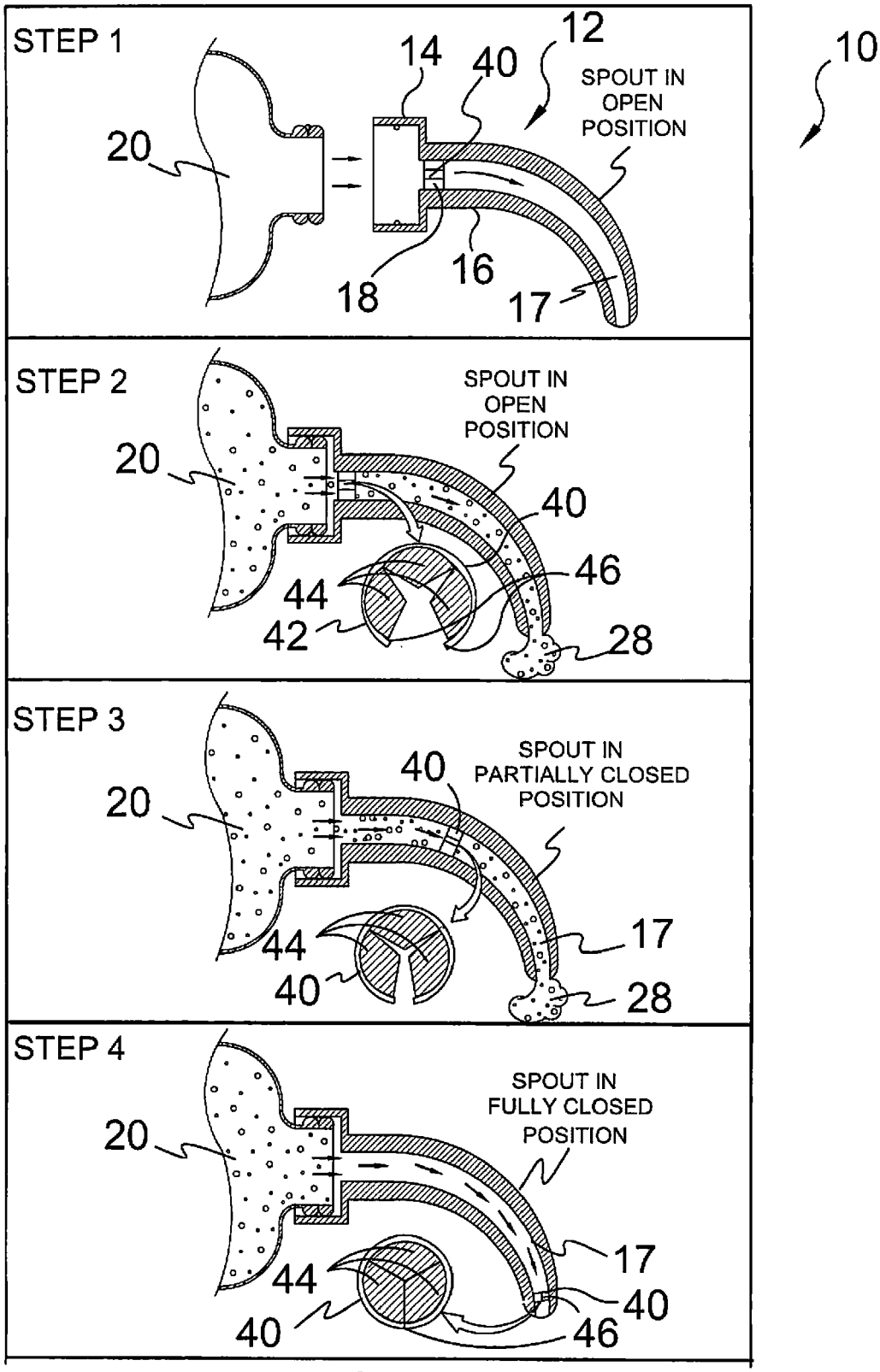
FIG. 5 is a stepwise view of the single-use nozzle having a shutter-like valve.
Figures 5A, 5B:
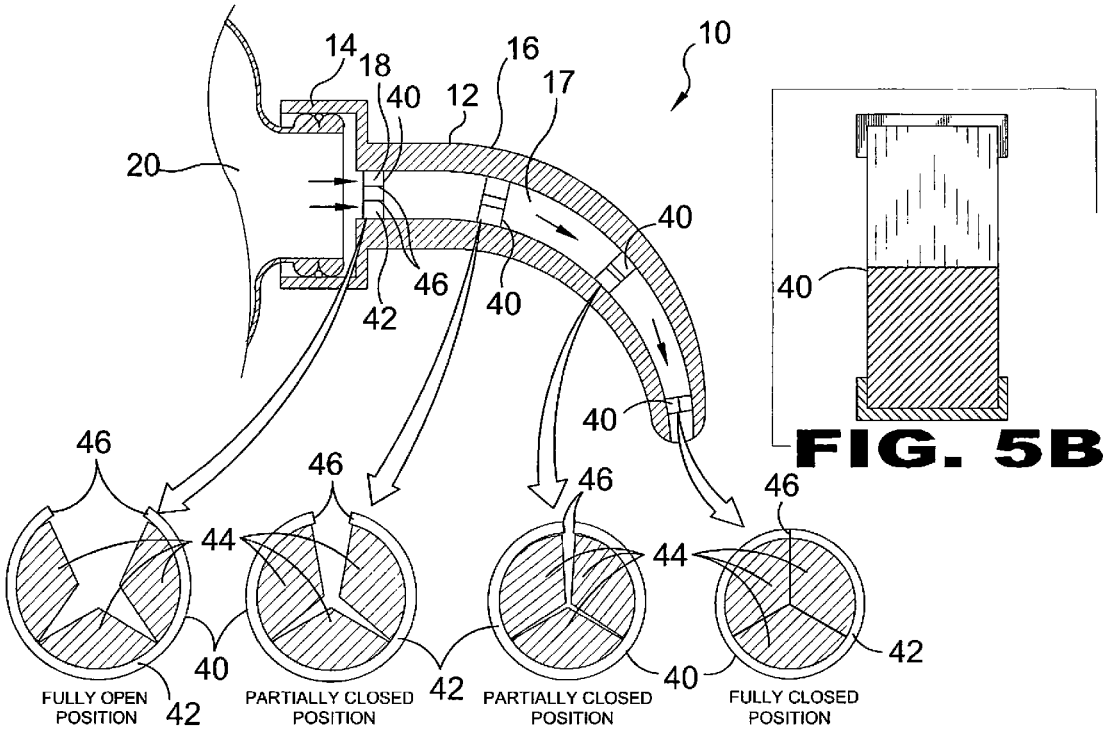

FIGS. 5A and 5B shown is an illustration of the single-use nozzle with an advancing shutter valve and a sectional view through said valve.

Figure 6:
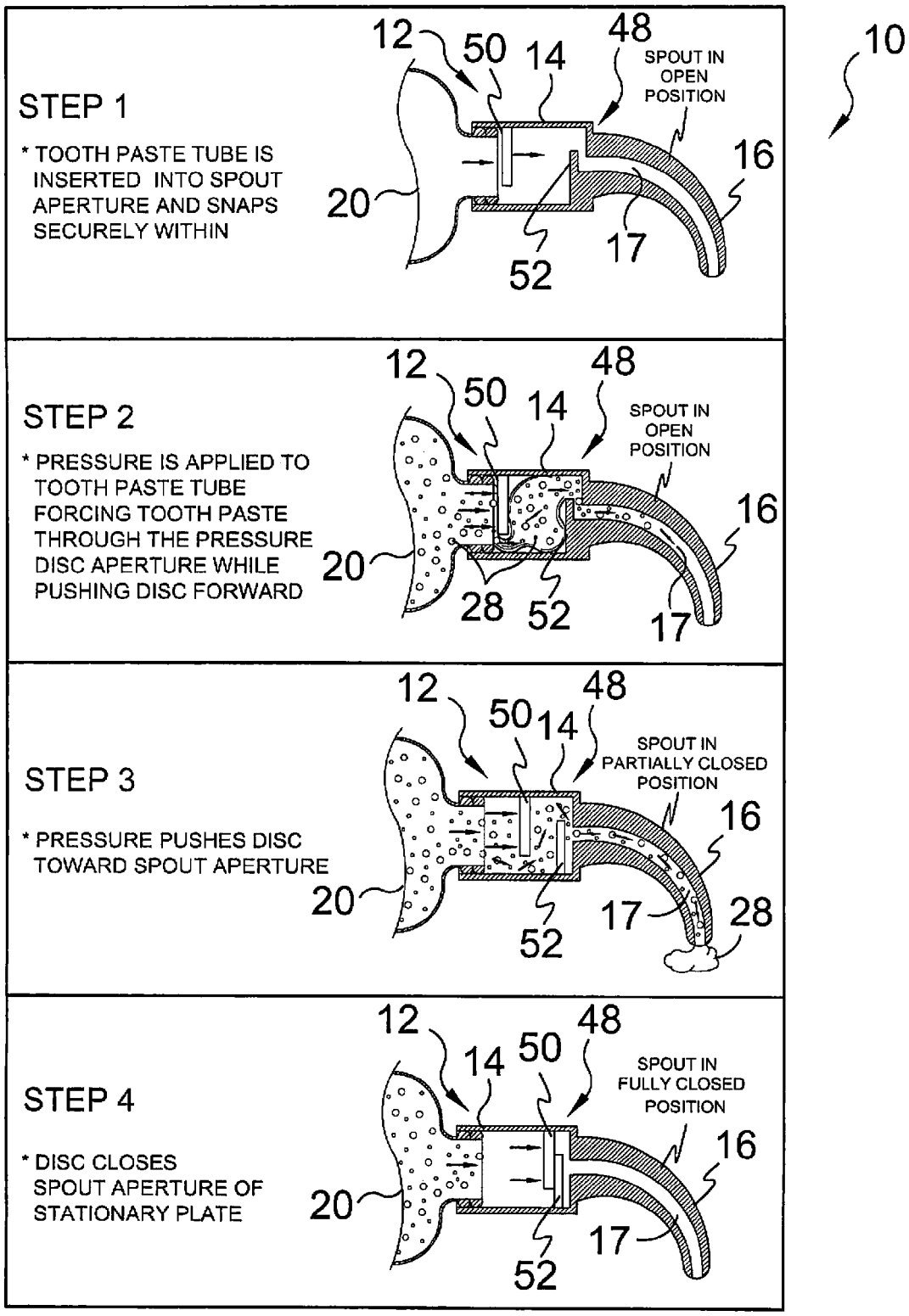

FIG. 6 is a stepwise view of the single-use nozzle having a displaceable valve.

Figure 6A:
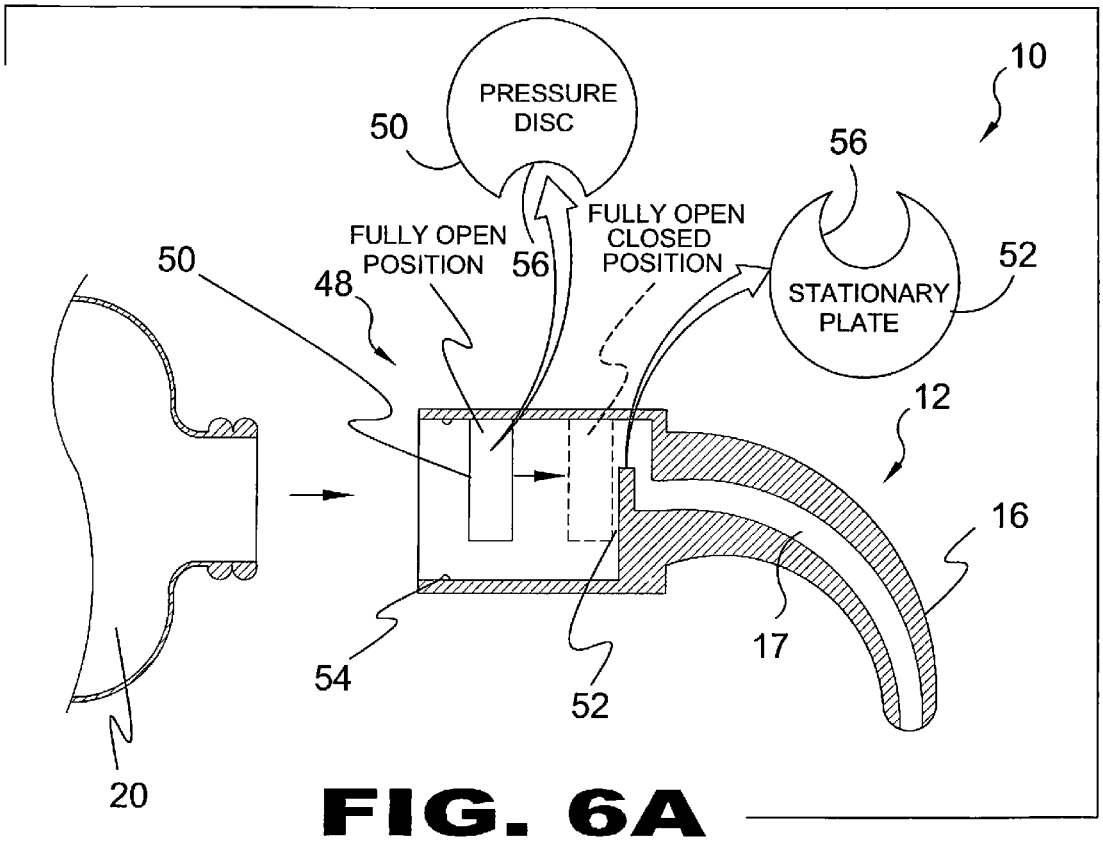

FIG. 6A is an enlarge view of the displaceable nozzle valve.

Figure 7:
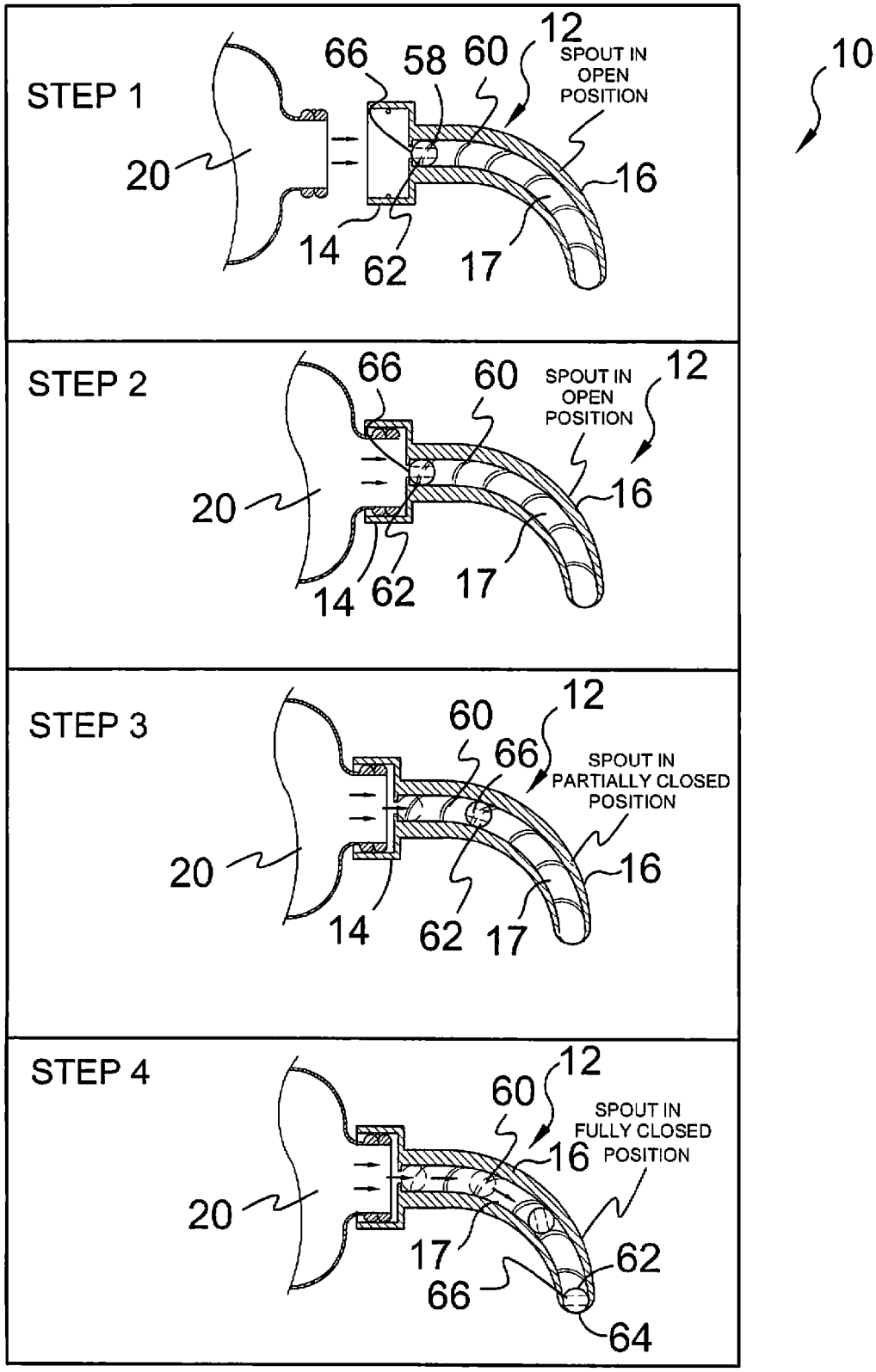

FIG. 7 is a stepwise view of the single-use nozzle having a ball valve.

Figure 7A:
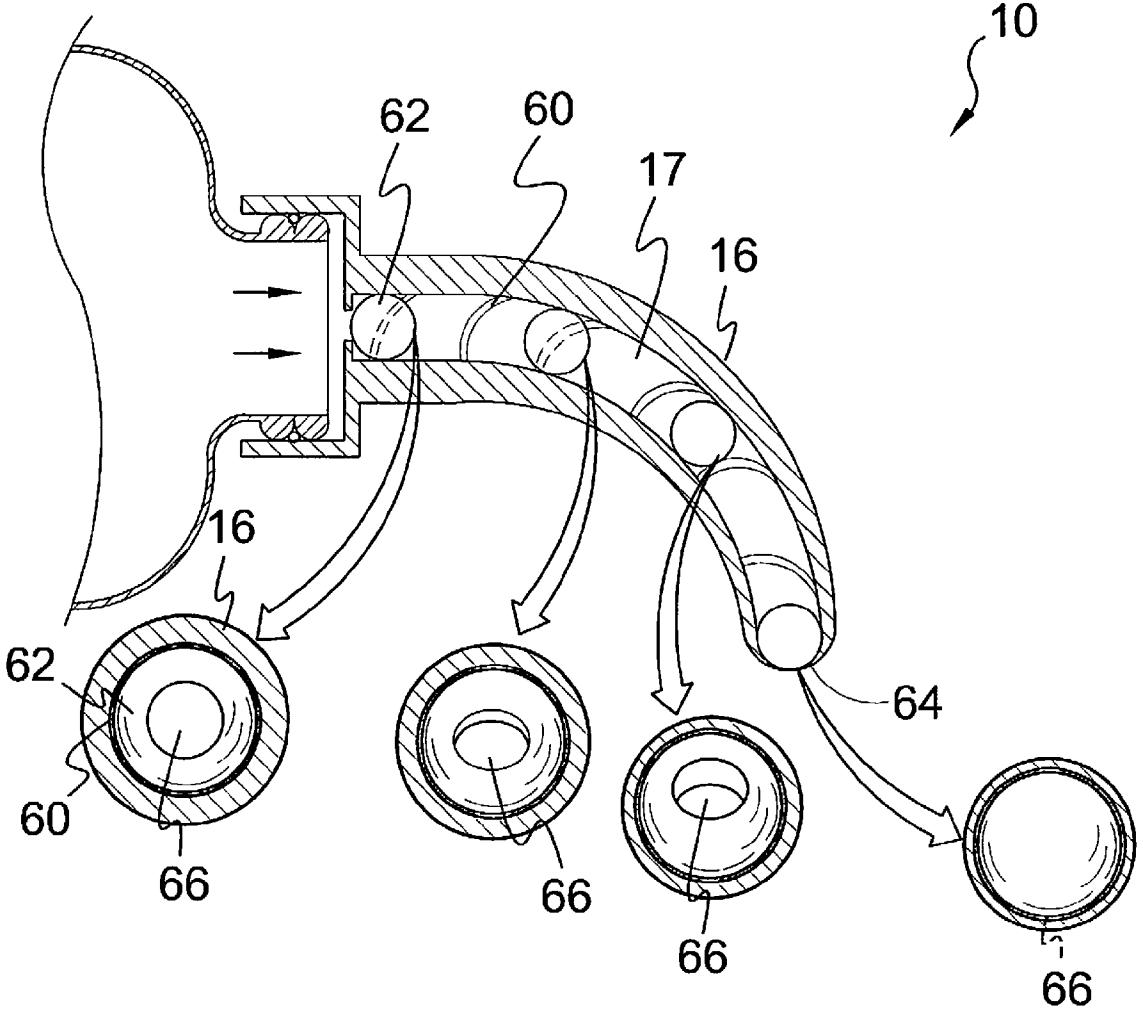

FIG. 7A is an illustration of the single-use nozzle with an advancing ball valve.

Figure 8:
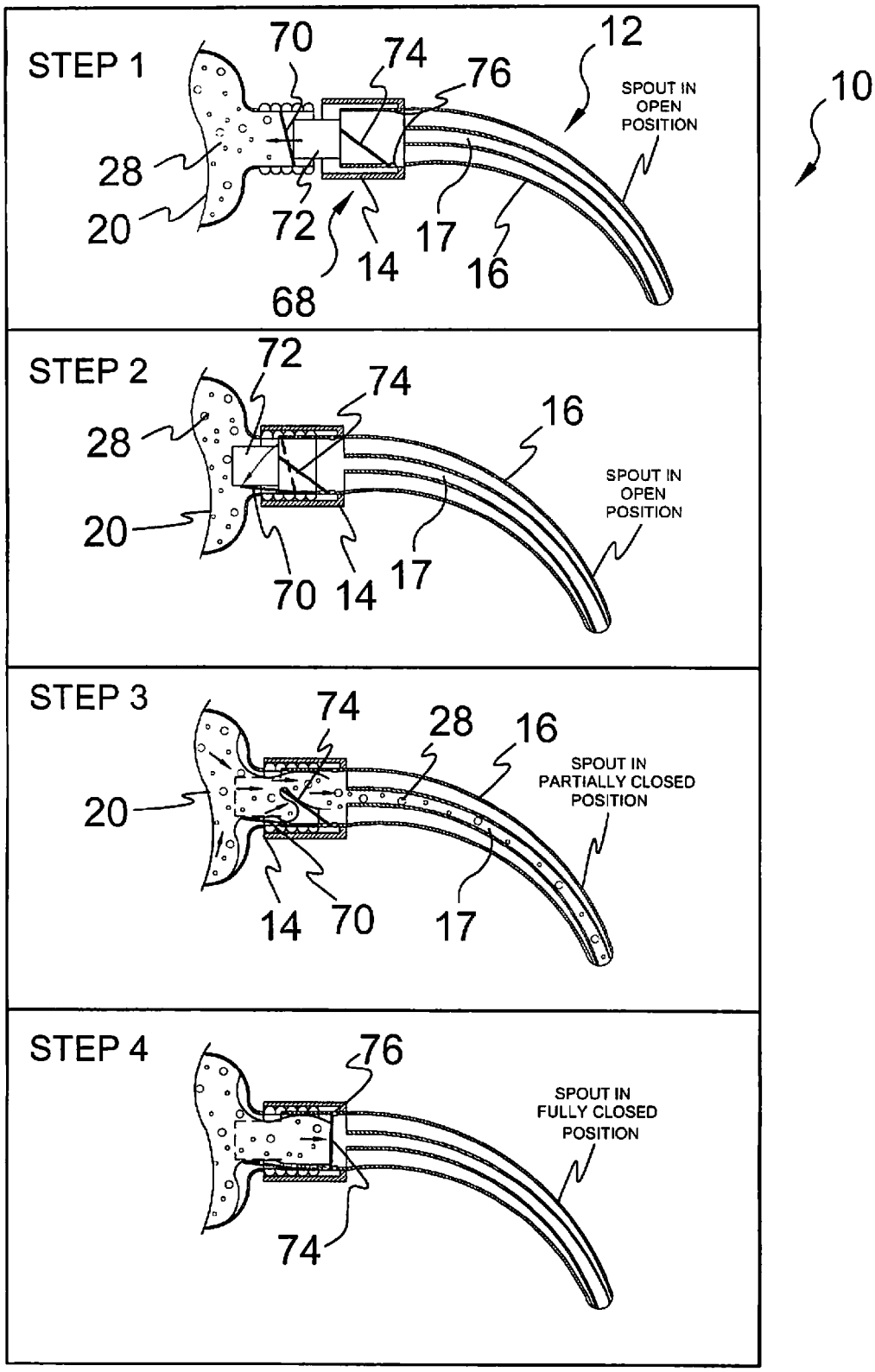

FIG. 8 is a stepwise view of the single-use nozzle having a pivotal valve.

Figure 8A:
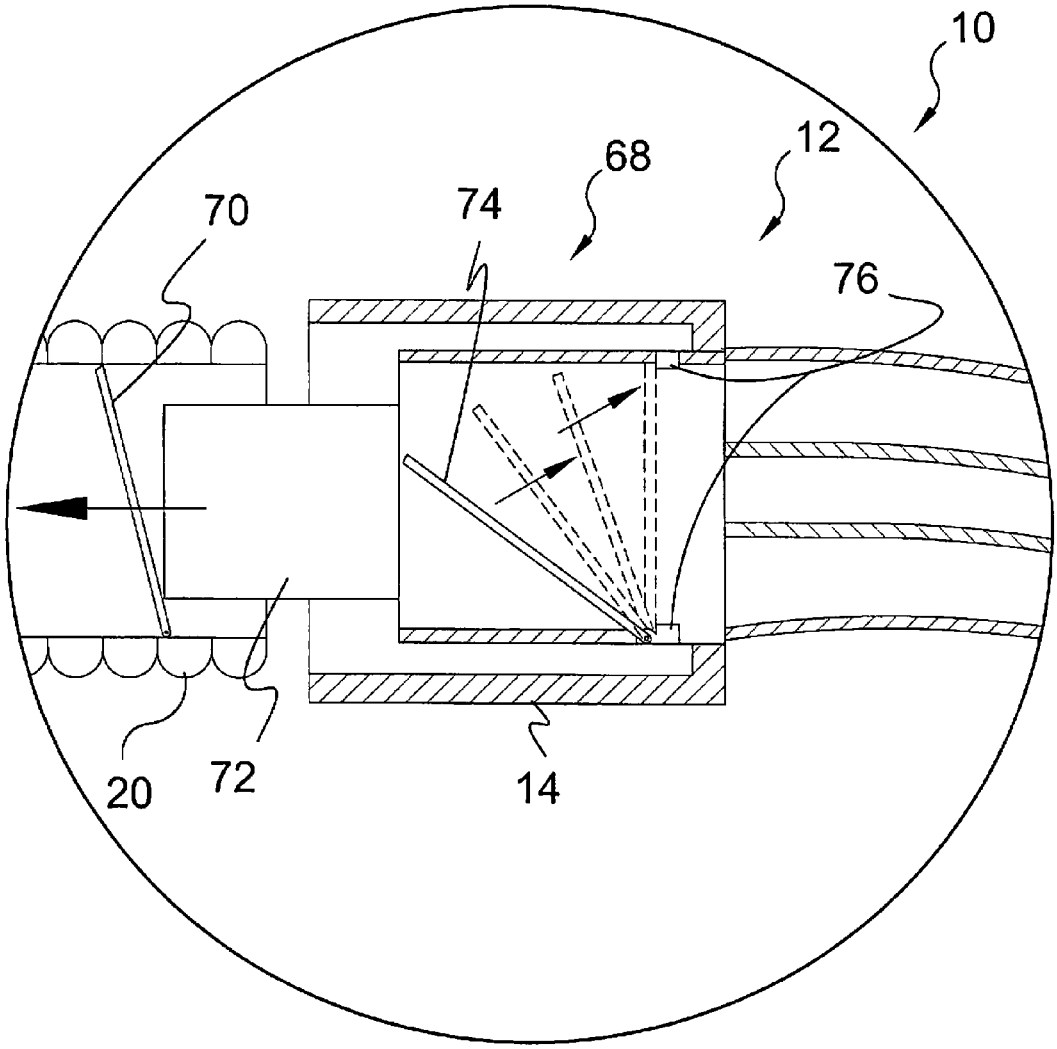

FIG. 8A is an illustration of the single-use nozzle with a pivotal valve.

DESCRIPTION OF THE REFERENCED NUMERALS

Turning now descriptively to the drawings, in which similar reference characters denote similar elements throughout the several views, the figures illustrate the Hygienic, Single Use Dentifrice Applicator and Periodontal Cross-Contamination Prevention System of the present invention. With regard to the reference numerals used, the following numbering is used throughout the various drawing figures.

10 Hygienic, Single Use Dentifrice Applicator and Periodontal Cross-Contamination Prevention System of the present invention
12 single use applicator
14 attachment collar
16 curvilinear nozzle
17 conduit of 16
18 valve member
22 user
24 contaminated toothpaste
26 toothbrush
28 dentifrice
30 mouth of 22
32 tooth of 22
34 cap of 20
36 threads of 14
38 threads of 20
40 shutter valve
42 shutter ring
44 shutter plate sections
46 split edge of 42
48 displaceable valve
50 pressure disc
52 stationary plate
54 snap-on nub
56 passage means cut-out
58 ball valve assembly
60 helical channel
62 ball valve
64 point of egress of 17
66 throughbore of 62
68 pivotal valve assembly
70 tube valve
72 valve plunger
74 applicator valve
76 valve stop

DETAILED DESCRIPTION OF THE PREFERRED EMBODIMENT

The following discussion describes in detail one embodiment of the invention (and several variations of that embodiment). This discussion should not be construed, however, as limiting the invention to those particular embodiments, practitioners skilled in the art will recognize numerous other embodiments as well. For definition of the complete scope of the invention, the reader is directed to appended claims.

Figure 1:
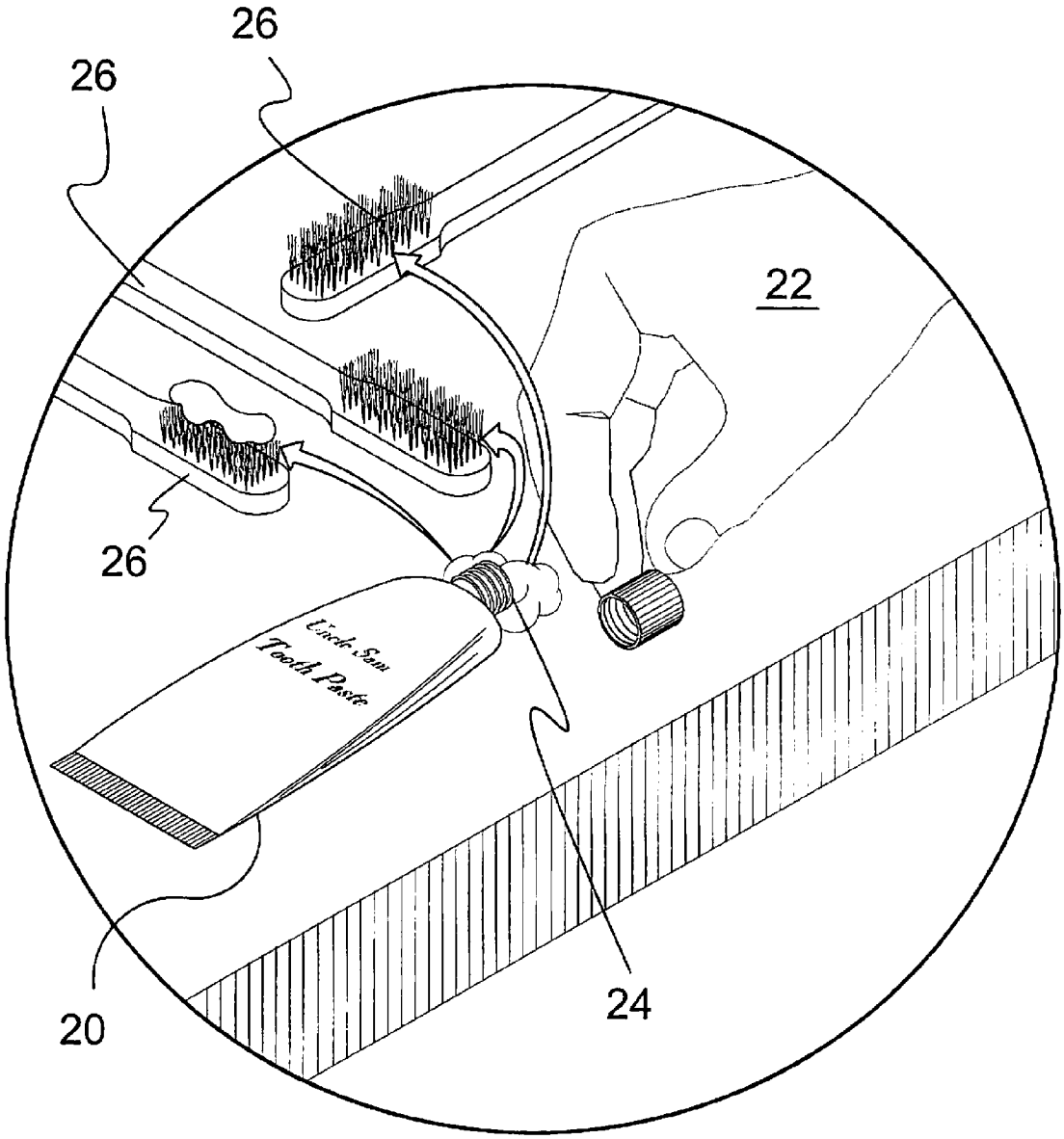
(PRIOR ART) FIG. 1
FIG. 1 is an illustrative view of the prior art.

FIG. 1 is an illustrative view of the prior art 20. Shown is an example of prior art comprising a deformable tube of toothpaste 20 that when utilized by multiple individuals can make the transmission of bacteria or disease from toothpaste 24 to toothbrush 26 a health risk to the user 22 which can be eliminated through use of disposable single use nozzles. The present invention provides a single-use nozzle having a collar with an outwardly extending tubular spout that decreases in diameter to a dispensing port. The nozzle has a curvilinear shape whereby any mateable container of a substance requiring oral cavity application can use the curvilinear nozzle to deliver said substance to a desired location in the desired predetermined amount.

Figure 2:
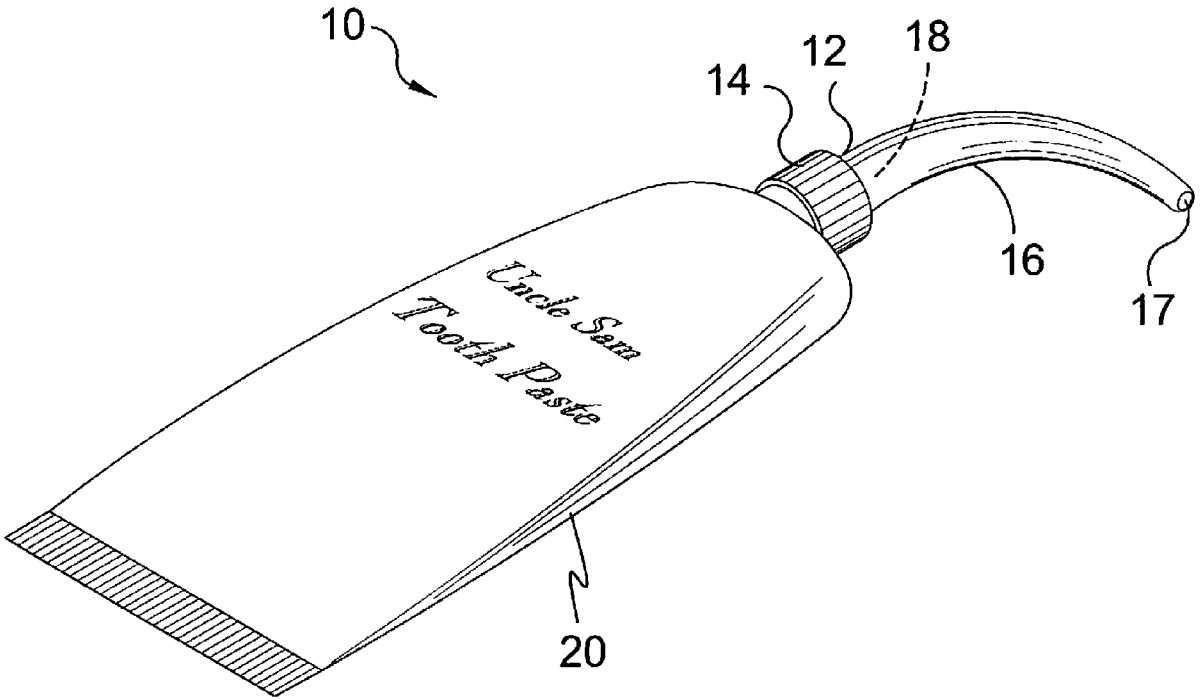
FIG. 2 is a perspective view of the periodontal/oral cross contamination prevention system of the present invention in use.

FIG. 2 is a perspective view of the periodontal/oral cross contamination prevention system 10 of the present invention in use. Shown is the single use applicator 12 attached to a toothpaste tube 20 via a threaded attachment collar 14 to provide for a single use application of a dental substance either to a desired location within an oral cavity or to prevent direct contact between the toothpaste dispenser nozzle 16 and the user's toothbrush. The nozzle 16 includes a central throughbore forming a conduit 17 having a nozzle valve 18 disposed therein that as the dental substance, in this case illustrated as toothpaste, is dispensed by pressure applied to the pliable tube 20 acts upon the valve 18 to block the throughbore 17 after a predetermined amount of dental substance has been dispensed.

Figure 3:
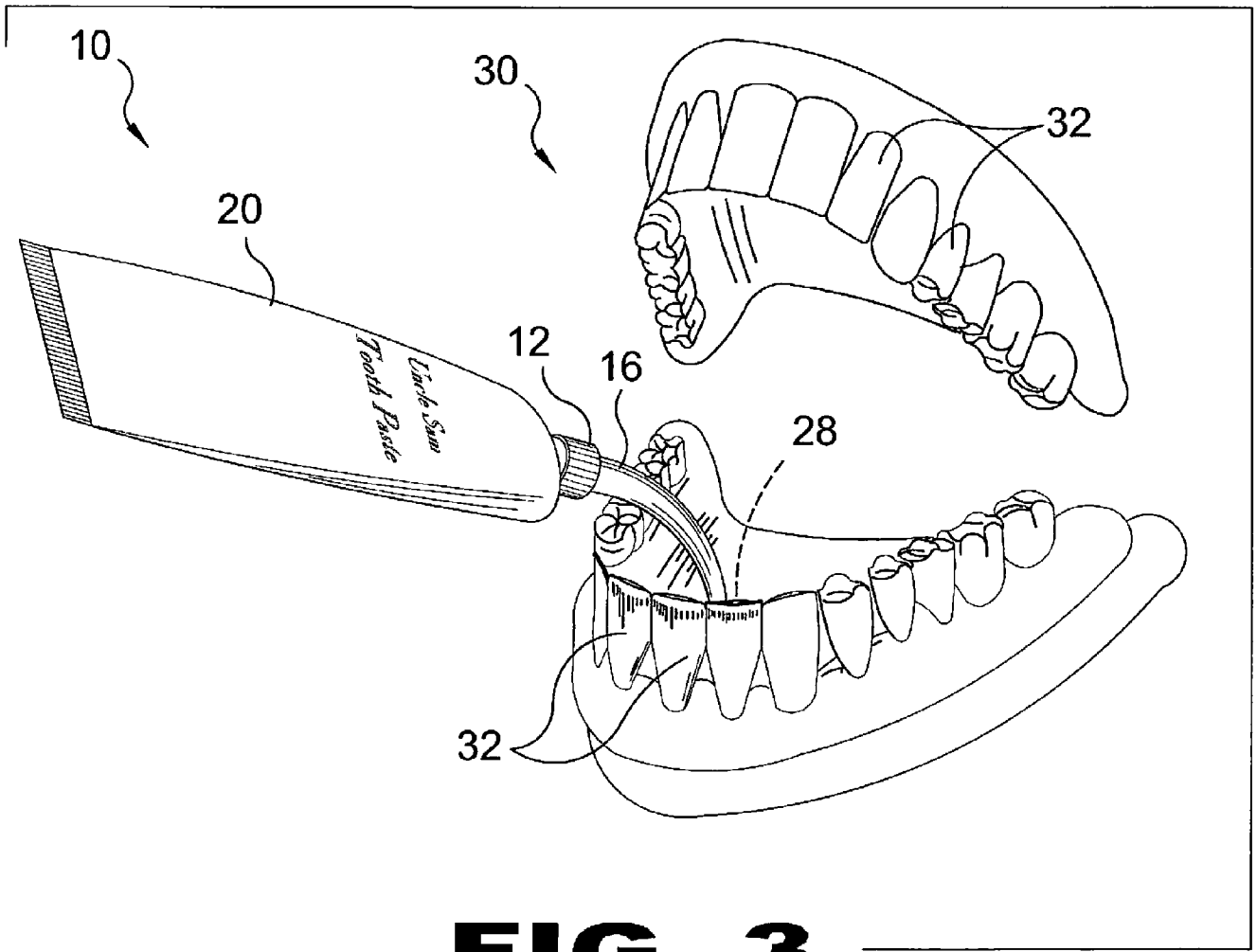
FIG. 3 is a perspective view of the periodontal/oral cross contamination prevention system of the present invention in use.

FIG. 3 is a perspective view of the periodontal/oral cross contamination prevention system of the present invention 10 in use. Shown is the single use applicator 12 in use with a toothpaste tube 20. The curvilinear form of the nozzle 16 allows for direct oral application of a dental dentifrice 28 to precise locations in one's mouth 30 such as exact location of gum line for sensitive teeth 32 or for placement of dentifrice 28 between or under orthodontic appliance.

Figure 4:
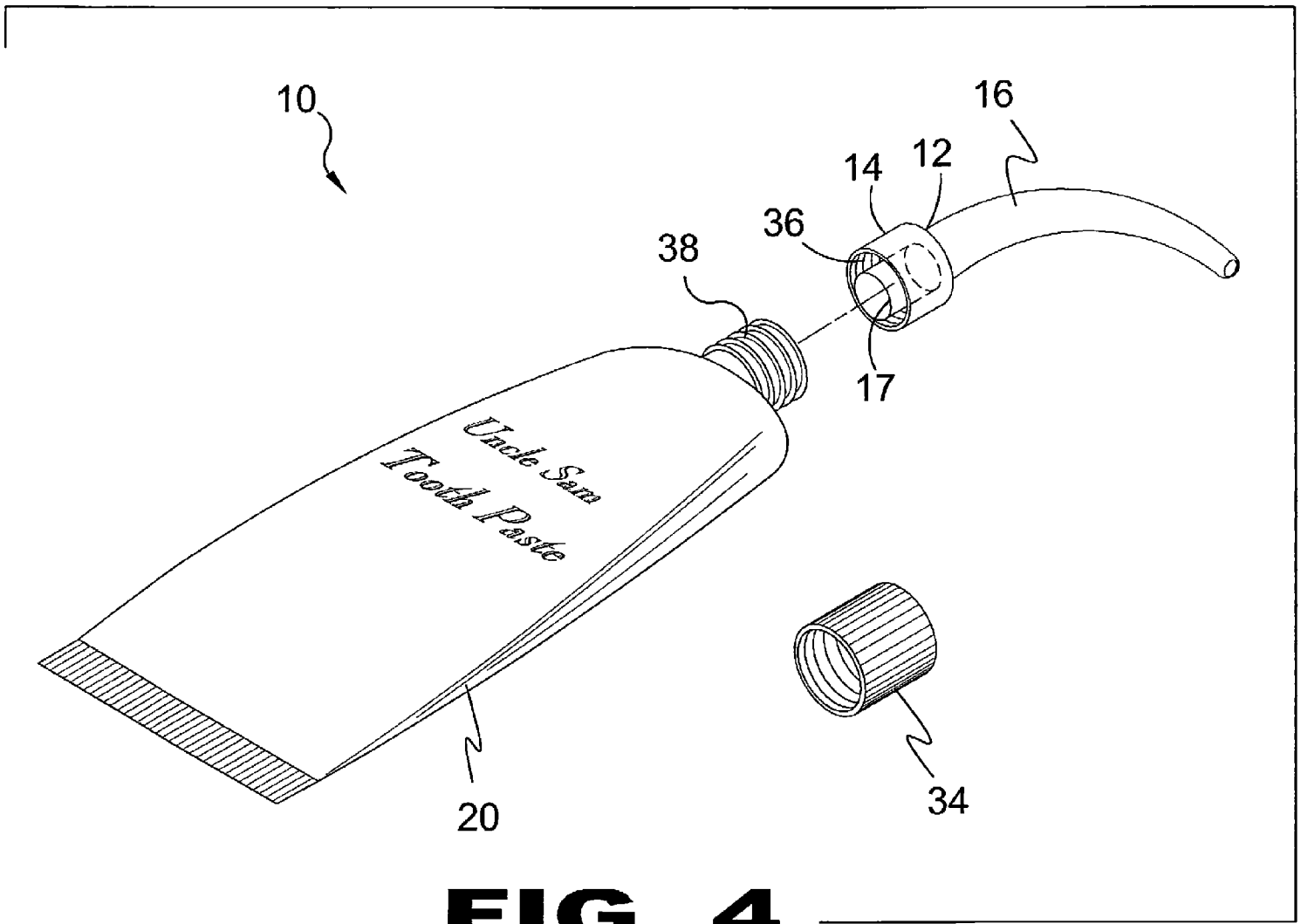
FIG. 4 is an illustrative view of the periodontal/oral cross contamination prevention system of the present invention during installation to a tube opening.

FIG. 4 is an illustrative view of the periodontal/oral cross contamination prevention system of the present invention 10 during installation. Shown is the single-use applicator 12 being installed to a typical dispensing end of a dental substance tube 20 much like a cap 34. The nozzle collar 14 has threads 36 that screw onto mating threads 38 on the tube 20 which normally accommodate the cap 34. Additionally the present invention 10 provides a curved and extended nozzle 16 with a central conduit 17 to aid the user in more precise application of a substance. Furthermore, the conduit 17 projects into the collar 14 thereby penetrating into the tube 20 upon threading to assure the introduction of fresh dentifrice therein.

FIG. 5 is a stepwise view of the single-use nozzle 12 having a shutter-like valve 40. Depicted is the single use applicator 12 of the present invention 10 that provides a collar 14 for engaging a pliable toothpaste tube 20. The first step of usage requires screwing the applicator 12 onto the tube 20. The applicator 12 has a nozzle 16 with a conduit 17 curvilinearly extending in a diametrically decreasing fashion with an interiorly movable valve member 18 whereby the applicator 12 is single use as a result it advancing down the conduit 17 allowing toothpaste 24 to be dispensed until the valve 18 moves to its blocking position whereby no further toothpaste 28 can be dispensed. Having no means to retract the valve 18 results in a single use applicator 12. As illustrated, the movable valve 18 is a shutter valve 40 comprising a resilient shutter-like cylindrical ring 42 with a split edge 46 on the side and internal plate sections 44 that are spaced apart when the split edges 46 of the shutter ring 42 are separated and abut one another when the split edges 42 meet thereby effectively forming a barrier restricting any further dispensing of the toothpaste 28. The shutter valve 40 advances down the conduit 17 along a curvilinear longitudinal axis of the curvilinear nozzle as generally depicted by the arrows in step 4 of FIG. 5 under pressure from the toothpaste 28 allowing toothpaste 28 to pass therethrough. The shutter valve 40 closes incrementally as it travels down the conduit 17 due to the decreasing diameter of the conduit 17 until the shutter valve 40 closes whereby no further toothpaste 28 will be dispensed and with no means for retracting the valve creates the single-use valve.

FIGS. 5A and 5B shown is an illustration of the single-use nozzle with an advancing shutter valve and a sectional view through said valve. Depicted is the single use applicator 12 of the present invention 10 that provides a collar 14 for engaging a pliable toothpaste tube 20. The first step of usage requires screwing the applicator 12 onto the tube 20. The applicator 12 has a nozzle 16 with a conduit 17 curvilinearly extending in a diametrically decreasing fashion with an interiorly movable valve member 18 whereby the applicator 12 is single use as a result it advancing down the conduit 17 allowing toothpaste 24 to be dispensed until the valve 18 moves to its blocking position whereby no further toothpaste can be dispensed. Having no means to retract the valve 18 results in a single use applicator 12. As illustrated, the movable valve 18 is a shutter valve 40 comprising a resilient shutter-like cylindrical ring 42 with a split edge 46 on the side and internal plate sections 44 that are spaced apart when the split edges 46 of the shutter ring 42 are separated and abut one another when the split edges 42 meet thereby effectively forming a barrier restricting any further dispensing of the toothpaste. The shutter valve 40 advances down the conduit 17 under pressure from the toothpaste 28 once the tube 20 is squeezed by the user thus allowing toothpaste 28 to pass therethrough. The shutter valve 40 closes incrementally as it travels down the conduit 17 due to the decreasing diameter of the conduit 17 until the shutter valve 40 closes whereby no further toothpaste will be dispensed and with no means for retracting the valve creates the single-use applicator 12.

FIG. 6 is a stepwise view of the single-use applicator 12 of the present invention 10 having a displaceable valve 48. The single use applicator 10 provides a collar 14 for engaging a pliable tube 20 of toothpaste 28 with a nozzle 16 curvilinearly projecting therefrom. A conduit 17 is disposed within said nozzle 16 to provide passage of toothpaste 28 from the tube 20 to the desired point of delivery. Shown is the displaceable valve 48 comprising a movable pressure disc 50 disposed within the collar 14 proximal to the point of egress of the dispensing tube 20 and a spaced apart stationary plate 52 disposed within said collar 14 proximal the conduit 17. The pressure disc 50 and the stationary plate 52 are offset to encourage passage of toothpaste 28 therethrough while they are in a spaced apart relation. The introduction of toothpaste 28 therethrough applies a bias to the pressure disc 50 thereby urging it towards the stationary plate 52 as the toothpaste 28 is being delivered through the conduit 17. Engagement of the pressure disc 50 with the stationary plate 52 prohibits further egress of the toothpaste 28.

FIG. 6A is an enlarged view of the displaceable valve 48 of the present invention 10. Depicted is the pressure disc 50 moving to engage the stationary plate 52 under pressure from the toothpaste allowing toothpaste to pass the valve 48 through cut-out passage means 56 in the disc 50 and the plate 52 and proceed through the conduit 17 of the nozzle 16 until the pressure disc 50 engages the stationary plate 52 whereby no further toothpaste will be dispensed and with no means for retracting, the displaceable valve 48 creates the single-use applicator 12. The attachment collar 14 further includes a snap-on nub 54 to enable the user to simply snap the applicator 12 on and of the dispensing tube 20 without threading.

FIG. 7 is a stepwise view of the single-use applicator 12 of the present invention 10 having a ball valve assembly 58. Depicted is the single use applicator 12 that provides collar 14 for engaging a pliable toothpaste tube 20 with a nozzle 16 curvilinearly projecting therefrom. A diametrically decreasing conduit 17 extends through the nozzle 16 with a helical charmel 60 therein. A ball valve 62 is positioned within the conduit 17 proximal the collar 14 when in the open static position. The ball valve 62 has a central throughbore 66 passing therethrough The introduction of toothpaste 28 into the conduit 17 urges the ball valve 64 forward along the helical channel 60 while the throughbore 66 permits toothpaste 28 to flow therethrough for delivery at the point of egress 64 of said conduit 17. The flow of toothpaste 28 is terminated upon the ball valve 62 reaching the distal end of said helical channel 60 wherein the throughbore 66 is in transverse relation to the point of egress 64. The diameter of the point of egress 64 is less than that of the ball valve 62 thereby prohibiting further travel thereof.

FIG. 7A is an illustration of the single-use applicator 12 of the present invention 10 with an advancing ball valve 62. As illustrated, the single use applicator 12 has a nozzle 16 that extends curvilinearly from the nozzle mounting collar 14. The nozzle 16 has an integral conduit 17 with and interiorly movable ball valve 62 whereby the applicator 12 is single use as a result of the ball valve 62 advancing down the helical channel 60 of the conduit 17 allowing toothpaste to be dispensed until the ball valve 62 moves to its blocking position whereby no further toothpaste can be dispensed. Depicted is the ball valve 62 having a throughbore 66 that advances down the helical channel 60 under pressure from the toothpaste allowing toothpaste to therethrough until the throughbore 66 rotates transversely out of alignment with the point of egress 64.

FIG. 8 is a stepwise view of the single-use applicator 12 of the present invention 10 having a pivotal valve assembly 68. Depicted is the single use applicator 12 having an additional element wherein the pliable toothpaste tube 20 has an integral tube valve 70 so that no toothpaste will be dispensed without employing the single-use applicator 12 with the pliable tube 20. The applicator 12 provides a collar 14 for engaging a pliable tube of toothpaste 20 and a nozzle 16 projects curvilinearly therefrom. A conduit 17 extends longitudinally through the nozzle 16 for delivering a pre-determined amount of toothpaste 28 to the distal end thereof. The proximal end of the conduit 17 projects beyond the edge of the collar 14 for entry into the dispensing tube 20 when engaged therewith thereby forming a valve plunger 72. A pivotal tube valve 70 is employed within the tube 20 and refuses egress of any toothpaste 28 until the valve plunger 72 drives it back to allow entrance into the conduit. A pivoting applicator valve 74 is disposed within the collar 14 and is driven towards the conduit 17 entrance as the toothpaste 28 travels through the conduit 17. Once the applicator valve 74 engages a valve stop 76 disposed at the conduit 17 entrance the flow of any further of toothpaste 28 therethrough is prohibited. The tube valve 70 within the dispensing tube 20 assures that no toothpaste 28 will be dispensed therefrom bypassing the usage of a new sanitized single use applicator.

FIG. 8A is an illustration of the single-use applicator 12 with a pivotal valve assembly 68. As illustrated, the valve plunger 72 extends from the nozzle mounting collar 14 into a tube 20 spout having an interior pivoting tube valve 70. The curvilinear spout is single use as a result of the pivot valve assembly 68 that allows toothpaste to be dispensed until the applicator pivot valve 74 pivots to its blocking position at the valve stop 76 whereby no further toothpaste can be dispensed. Depicted is the applicator valve 74 pivoting under pressure from the toothpaste allowing toothpaste to move past the valve as it pivots to closure so that no further toothpaste will be dispensed until replaced with a new, sanitized applicator 12.

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention

The invention claimed is:

1. A hygienic, single use dentifrice applicator and periodontal cross-contamination prevention system to enable the user to apply a dentifrice agent to a specific location including ones that are difficult to reach or isolate and to prevent cross-contamination between users of the same dentifrice dispensing tube, said applicator comprising:

a) a threaded attachment collar for fastening said applicator to a tube for dispensing a predetermined amount of a dentifrice agent;

b) a curvilinear nozzle projecting from said collar;

c) a conduit extending through said curvilinear nozzle, a portion of said conduit longitudinally extending along a curvilinear longitudinal axis of said curvilinear nozzle, wherein a proximal end thereof allows for the introduction of said dentifrice therein and delivers it to a user specified area from a distal end thereof;

d) a valve member disposed within said conduit that disables said applicator when said valve is in a closed position thereby rendering the applicator inoperative for a subsequent use, and said valve moves within said conduit from an open position along a portion of said curvilinear longitudinal axis to said closed position.

2. The hygienic, single use dentifrice applicator recited in claim 1, wherein the diameter of said conduit decreases as it approaches the distal end of said nozzle.

3. The hygienic, single use dentifrice applicator recited in claim 2, wherein said valve member is a shutter valve.

4. The hygienic, single use dentifrice applicator recited in claim 3, wherein said shutter valve comprises:

a) a resilient, substantially cylindrical outer shutter ring having a split edge enabling said shutter ring to have a larger diameter when said edges are separated in an open static position; and b) a plurality of substantially pie-shaped shutter plate sections that provide gaps therebetween when said shutter valve is in the open static position.

5. The hygienic, single use dentifrice applicator recited in claim 4, wherein said shutter valve is disposed in the proximal end of said conduit prior to usage.

6. The hygienic, single use dentifrice applicator recited in claim 5, wherein said shutter valve is in the open static position prior to usage.

7. The hygienic, single use dentifrice applicator recited in claim 1, wherein said valve member is a ball valve assembly.

8. The hygienic, single use dentifrice applicator recited in claim 7, wherein said ball valve assembly comprises:

a) a ball valve disposed within said conduit proximal said collar when in the fully open, static position;

b) a helical channel integral with the interior of said conduit; and c) means of passage to enable the flow of said dentifrice during operation.

9. The hygienic, single use dentifrice applicator recited in claim 8, wherein said passage means is a throughbore centrally disposed in said ball valve.

10. The hygienic, single use dentifrice applicator recited in claim 9, wherein said throughbore is linearly aligned with said conduit when in the fully open, static position.

11. The hygienic, single use dentifrice applicator recited in claim 10, wherein the introduction of said dentifrice in said conduit provides a bias to urge said ball valve towards the distal end of said conduit.

12. The hygienic, single use dentifrice applicator recited in claim 11, wherein said throughbore allows flow of said dentifrice therethrough to the point of egress during the travel thereof.

13. The hygienic, single use dentifrice applicator recited in claim 12, wherein the diameter of said ball valve is greater than that of said point of egress.

14. The hygienic, single use dentifrice applicator recited in claim 13, wherein said ball valve is refused egress though said point of egress due to the diametric differential between the two.

15. The hygienic, single use dentifrice applicator recited in claim 14, wherein said helical channel guides the rotation of said ball valve whereby the orientation of said throughbore is in transverse relation to said point of egress upon termination of movement of said ball valve.

16. A hygienic, single use dentifrice applicator and periodontal cross-contamination prevention system to enable the user to apply a dentifrice agent to a specific location including ones that are difficult to reach or isolate and to prevent cross-contamination between users of the same dentifrice dispensing tube, said applicator comprising:

a threaded attachment collar for fastening said applicator to a tube for dispensing a predetermined amount of a dentifrice agent;

a nozzle projecting from said collar;

a conduit extending longitudinally through said nozzle wherein the proximal end thereof allows for the introduction of said dentifrice therein and delivers it to a user specified area from the distal end thereof;

a valve member disposed within said applicator that disables said applicator when said valve is in a closed position thereby rendering it useless and requires the user to attach a fresh, uncontaminated applicator for subsequent use;

wherein said nozzle is curvilinear for increased ease of application of said dentifrice;

wherein the diameter of said conduit decreases as it approaches the distal end of said nozzle;

wherein said valve member is a shutter valve;

wherein said shutter valve comprises:

i) a resilient, substantially cylindrical outer shutter ring having a split edge enabling said shutter ring to have a larger diameter when said edges are separated in an open static position; and ii) a plurality of substantially pie-shaped shutter plate sections that provide gaps therebetween when said shutter valve is in the open static position;

wherein said shutter valve is disposed in the proximal end of said conduit prior to usage;

wherein said shutter valve is in the open static position prior to usage; and wherein said dentifrice is introduced into said conduit when the user squeezes said dispensing tube.

17. The hygienic, single use dentifrice applicator recited in claim 16, wherein the viscosity of said dentifrice applies pressure against said shutter plate section thereby advancing said shutter valve towards the distal end of said conduit.

18. The hygienic, single use dentifrice applicator recited in claim 17, wherein said dentifrice passes through said gaps between said shutter plate sections and is delivered to the area proximal the distal end of said conduit as said shutter valve advances therethrough.

19. The hygienic, single use dentifrice applicator recited in claim 18, wherein the advancement of said shutter valve through the decreasing diameter of said conduit urges said split edges of said shutter ring together thereby incrementally reducing the gap between said shutter plate sections.

20. The hygienic, single use dentifrice applicator recited in claim 19, wherein said shutter valve is fully closed with no gaps between said shutter plate sections upon reaching the distal end of said conduit thereby restricting further passage of any dentifrice therethrough.

21. The hygienic, single use dentifrice applicator recited in claim 20, wherein closure of said shutter valve effectively renders said applicator useless since there is no means of retraction thereof and requires a new, uncontaminated applicator to be applied for subsequent usage of said dentifrice.

* * * * *